US007194949B2

(12) United States Patent
Noda

(10) Patent No.: US 7,194,949 B2
(45) Date of Patent: Mar. 27, 2007

(54) MAGNET TYPE RODLESS CYLINDER

(75) Inventor: Mitsuo Noda, Ichinomiya (JP)

(73) Assignee: Howa Machinery, Ltd., Kiyosu (JP)

( * ) Notice: Subject to any disclaimer, the term of this patent is extended or adjusted under 35 U.S.C. 154(b) by 0 days.

(21) Appl. No.: 11/260,227

(22) Filed: Oct. 28, 2005

(65) Prior Publication Data

US 2006/0090641 A1 May 4, 2006

(30) Foreign Application Priority Data

Nov. 4, 2004 (JP) ..... 2004-320004

(51) Int. Cl.
*F15B 15/14* (2006.01)
*F15B 15/00* (2006.01)

(52) U.S. Cl. ..... 92/88; 92/169.1

(58) Field of Classification Search ..... 91/DIG. 4; 92/88, 169.1, 177

See application file for complete search history.

(56) References Cited

U.S. PATENT DOCUMENTS 4,488,477 A * 12/1984 Miyamoto ..... 92/85 R
4,601,234 A * 7/1986 Hoinkis ..... 92/88
4,744,287 A * 5/1988 Miyamoto ..... 92/13.7
5,844,340 A * 12/1998 Noda ..... 92/88
6,148,714 A * 11/2000 Abe et al. ..... 92/88
6,205,906 B1 * 3/2001 Suzuki et al. ..... 92/88

FOREIGN PATENT DOCUMENTS

JP 4-113305 10/1992
JP 4-357310 12/1992
JP 2514499 7/1996

* cited by examiner

*Primary Examiner*—Thomas E. Lazo
(74) *Attorney, Agent, or Firm*—Finnegan, Henderson, Farabow, Garrett & Dunner, L.L.P.

(57) ABSTRACT

A magnet type rodless cylinder comprised of cylinder tube of a double tube structure provided with an outside tube of an elliptical flattened outside circumferential shape and two inside tubes inserted into the outside tube. When pressurized air is supplied alternately to the inside tubes from a port provided at an end cap, two pistons move reciprocatingly inside the inside tubes. Due to this reciprocating motion, this reciprocating motion causes reciprocating motion of a slide magnetically coupled with the two pistons at the outside of the outside tube. The inside pressure caused by the pressurized air acts exclusively on the inside tubes and does not directly act on the outside tube of the flattened outside circumferential shape, so the thickness of the outside tube can be reduced and, even if the cylinder tube is made a double tube structure, the total thickness will not become greater than in the past. For this reason, it is possible to provide a practical flattened type of magnetic cylinder with a small height without greatly increasing the magnetic coercive force.

8 Claims, 5 Drawing Sheets

MAGNET TYPE RODLESS CYLINDER

BACKGROUND OF THE INVENTION

1. Field of the Invention

The present invention relates to a magnet type rodless cylinder of a type comprised of a cylinder tube at the inside of which is formed a cylinder bore in which is arranged a piston so as to be able to move in the tube axial direction and at the outside circumference of which is arranged a single slide so as to be able to move in the tube axial direction, the piston and slide being magnetically connected, more particularly relates to a magnet type rodless cylinder where the cylinder tube has a noncircular shape, in particular has a flattened shape.

2. Description of the Related Art

As this type of magnet type rodless cylinder, for example, there is the one described in Japanese Utility Model Publication (A) No. 4-11305. The magnet type rodless cylinder of Japanese Utility Model Publication (A) No. 4-11305 reduces the thickness (height) of the cylinder or increases the pressure receiving area of the piston or increases the magnetic coercive force by making the cylinder tube and piston to flattened cross-sectional shapes in their diametrical directions. Further, Japanese Patent Publication (A) No. 4-357310 describes making the cylinder tube and piston elliptical or peanut-shaped cross-sectional shapes. Further, Japanese Utility Model Registration No. 2514499 discloses arranging two magnet type rodless cylinders in parallel and guiding a single slide spanning these two cylinders.

In the generally used magnet type cylinders, the cylinder tube and cylinder bore have true circular cross-sectional shapes. For this reason, when the tube is subjected to inside pressure, the tube will uniformly deform (expand) in cross-section, so the stress acting on the tube will also be uniform and no local concentrations of strain or stress will occur. As opposed to this, in a tube with a flat (noncircular) outside shape like in Japanese Utility Model Publication (A) No. 4-11305 and Japanese Patent Publication (A) No. 4-357310, the cylinder bore also has a noncircular cross-sectional shape, so if the tube is subjected to inside pressure due to fluid inside it, the tube will not deform uniformly. For this reason, when using a noncircularly shaped cylinder tube, the tube will be subjected to stress concentrations or local deformation and sometimes will have extremely large maximum stress and deformation.

To solve this problem, it may be considered to increase the tube thickness so as to raise the tube rigidity, but if increasing the tube thickness, it is necessary to commensurately increase the magnetic coercive force coupling the piston and slide. In this case, the required magnetic coercive force will sometimes be several times larger than the magnetic coercive force when using a tube with a circular cross-sectional shape. For this reason, while a magnet type rodless cylinder having a tube of a noncircular shape has existed as an idea, none has even been practically realized up to now.

On the other hand, while Japanese Utility Model Registration No. 2514499 describes two magnet type rodless cylinders arranged in parallel and a single slide provided for these two cylinders, this single slide is provided inside it with separate outside magnets or magnetic bodies corresponding to the respective cylinders. For this reason, the magnet type rodless cylinder of Japanese Utility Model Registration No. 2514499 has the problems of an increase in the number of parts and complicated assembly.

Further, in general conventional magnet type rodless cylinders, when the piston (that is, the inside magnets) moves due to inside pressure, the movement of the inside magnets causes the slide to be attracted and moved. The slide is moved by this mechanism. The size of the attraction force at this time is used as an indicator of the transport capacity of the magnet type rodless cylinder and is usually called the "magnetic coercive force".

FIG. 6 shows in a simplified manner the cross-section of a general conventional magnet type rodless cylinder along the cylinder axis. Reference numeral 100 indicates a cylinder tube, while 101 indicates a slide arranged outside of the tube. As shown in FIG. 6, the slide 101 outside of the tube 100 is provided with four outside magnets 102, while the piston 103 inside the tube 100 is provided with four inside magnets 104—both in the axial direction. Further, the four magnets forming the outside magnets 102 and the four magnets forming the inside magnets 104 are arranged so that the same poles of the magnets face each other across the yokes 105 in the axial direction. The magnets of the inside magnets 104 and the magnets of the outside magnets 102 are arranged so that different poles face each other in the radial direction.

Here, the magnetic coercive force is defined as the axial direction force acting at the slide 101 in the state where the slide 101 is fixed so that it cannot move in the axial direction and when fluid pressure is applied to the piston 103 to make the inside magnets 104 displace in the axial direction with respect to the slide 101 (outside magnets 102). As shown in FIG. 5, in the stationary state where no fluid pressure is acting, that is, the state where of the four outside magnets, the outside magnets 104, 102 face each other in the radial direction and do not displace in the cylinder axial direction, as shown by the point A, the magnetic coercive force becomes zero. Further, the magnetic coercive force, as shown in point B of FIG. 5, becomes the maximum value Max when the relative displacement of the magnets 102, 104 becomes about half of the pitch of arrangement L of the magnets 102, 104 in the axial direction.

In this way, in a general magnet type rodless cylinder, stationary state, the inside magnets 104 and the outside magnets 102 attract each other in the radial direction and are aligned in the axial direction, so in the stationary state, the magnetic coercive force becomes zero. Therefore, if making this piston 103 move from this state, no magnetic coercive force acts until relative displacement occurs between the inside magnets and outside magnets in the axial direction. Even if the piston 103 moves, sufficient attraction force does not act on the outside magnets 102. For this reason, in a conventional magnet type rodless cylinder, at the time of start of operation from the stationary state, even if the piston 103 starts to move, the slide 101 will not start to move smoothly following this, that is, the so-called "stick-slip phenomenon" is seen, and other problems occur.

This problem naturally occurs in each magnet type rodless cylinder in two magnet type rodless cylinders arranged in parallel at a relatively large distance as in Japanese Utility Model Registration No. 2514499 and in cylinders provided with noncircularly shaped tubes as in Japanese Utility Model Publication (A) No. 4-11305 and Japanese Patent Publication (A) No. 4-357310.

SUMMARY OF THE INVENTION

In view of the problems in the related art as set forth above, one of the objects of the present invention is to provide a magnet type rodless cylinder which solves the problems of concentration of strain and stress due to inside pressure and is suitable for practical use, that is, one provided with a cylinder tube having a noncircular outside shape and easy to assemble. Further, another object of the present invention is to provide a magnet type rodless cylinder enabling smooth operation.

To solve this problem, according to the present invention, one or more of the objects as set forth above are achieved by a magnet type rodless cylinder, according to the present invention, comprising a cylinder tube formed with a noncircular cross-sectional shape, pistons arranged in cylinder bores formed inside the cylinder tube so as to be able to move in a tube axial direction, and a single slide arranged at an outside circumference of the cylinder tube and guided so as to be able to move in the tube axial direction all coupled magnetically, wherein the cylinder tube is comprised of an outside tube with a noncircular cross-sectional shape and a plurality of inside cylinder tubes inserted inside the outside tube, pistons are arranged in cylinder bores formed inside the inside tubes, and the plurality of pistons and the single slide are magnetically coupled.

According to the present invention, the cylinder tube is comprised of an outside tube having a noncircular outside circumferential shape at the inside of which a plurality of inside cylinder tubes are housed, pistons are accommodated in the inside cylinder tubes, and a slide guided by the outside tube is magnetically coupled with. For this reason, the pressure of the working fluid acts only on the inside cylinder tubes. The noncircularly shaped outside tube is not directly acted on by the fluid pressure. For this reason, the noncircularly shaped outside tube does not suffer from any deformation or concentration of stress due to the fluid pressure.

Further, the thickness of the tube as a whole is the total of the thicknesses of the inside cylinder tubes and the outside tube, but the inside cylinder tubes can be made similar thicknesses as the case of conventional magnet type rodless cylinders. Further, since the outside tube is not subjected to any inside pressure, it can be made extremely small in thickness. As a result, the total thickness of the inside cylinder tubes and the outside tube does not greatly increase compared with a cylinder tube of a conventional true circle cross-sectional shape.

For this reason, it is possible to provide a flattened type of magnet cylinder with a small height (thickness) without greatly increasing the magnetic coercive force. Further, it is not necessary to provide outside magnets (or magnetic bodies) arranged outside the outside tube to match with the plurality of inside magnets inside the inside cylinder tubes. It is possible to use a common member surrounding the plurality of inside cylinder tubes as a whole and therefore possible to reduce the number of parts.

Further, in the present invention, the inside magnets of the pistons inserted into the cylinder bores of the inside tubes magnetically affect each other and repel each other in the tube axial direction, so the inside magnets stop in the state displaced slightly with respect to the stopped slide in the axial direction. For this reason, in the present invention, in the stationary state, a magnetic coercive force is generated between the inside magnets and slide due to the displacement. At the time of start of operation, it is possible to suppress the occurrence of the stick-slip phenomenon and possible to achieve smooth slide operation.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENT

Figure 1:
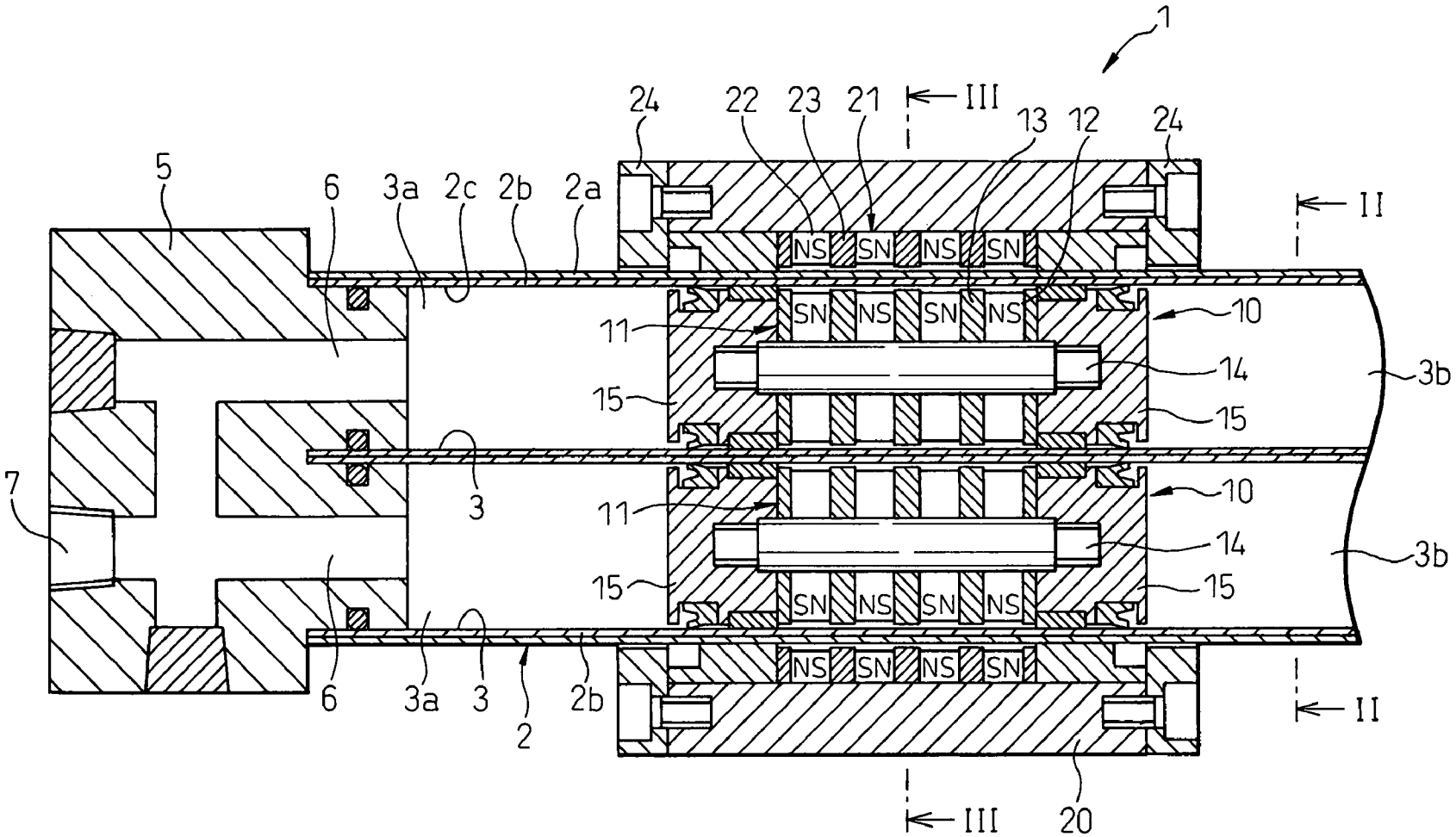
FIG. 1 is a vertical cross-sectional view of a magnet type rodless cylinder of an embodiment of the present invention.
Figure 2:
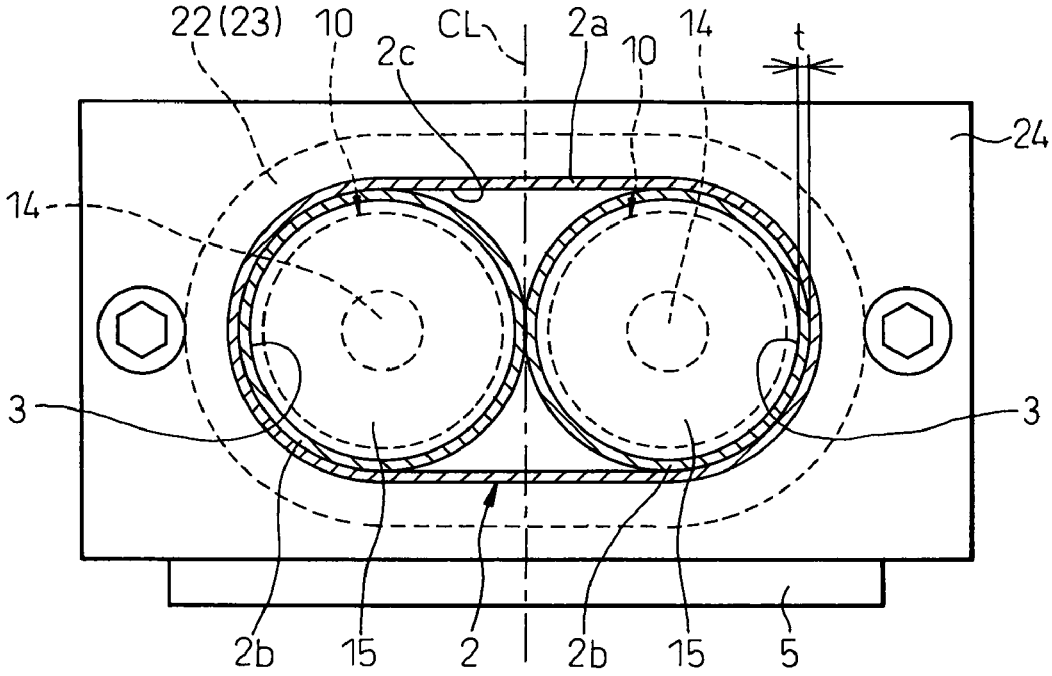
FIG. 2 is a cross-sectional view along the line II—II of FIG. 1.
Figure 3:
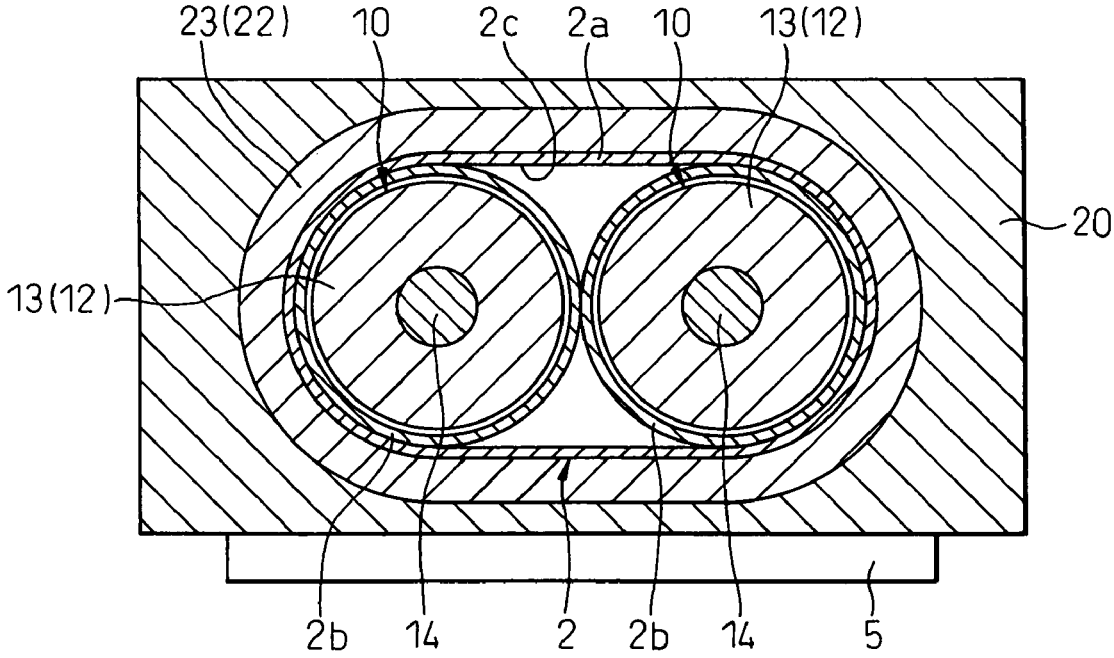
FIG. 3 is a cross-sectional view along the line III—III of FIG. 1.

Referring to FIGS. 1 to 3, a magnet type rodless cylinder 1 of an embodiment of the present invention will be explained. The cylinder tube 2 is comprised of a double tube structure comprised of an outside tube 2*a* with a cross-sectional outside circumference forming a flattened ellipse having a long axis (width direction) and short axis (thickness or height direction) and a plurality of (here, two) inside cylinder tubes 2*b* of true circular shapes arranged at the inside of the same. The two inside cylinder tubes 2*b* are inserted into the elliptical bore 2*c* of the inside of the outside tube 2*a* and are arranged in parallel in the elliptical bore 2*c* in the state with parts of their outside circumferences in close contact.

As shown in FIG. 2, the cross-sectional shape of the cylinder tube 2 as a whole is formed line symmetrically about the center axis CL of the length in the long axis direction. Further, the outside tube 2*a* and the inside cylinder tubes 2*b* match in length in the axial direction.

The flattened outside tube 2*a* is comprised of a nonmagnetic material constituted by an aluminum alloy drawn or extruded to an angular shape, a stainless steel tube, an FRP, a heat shrinking tube, etc. Further, the two inside tubes 2*b* are comprised of nonmagnetic materials constituted by an aluminum alloy drawn or extruded to angular shapes, stainless steel tubes, ceramic tubes, etc.

At the longitudinal end of the cylinder tube 2, an end cap 5 is fastened to close the ends of the cylinder bores 3, 3 of the inside tubes 2*b*. The end cap 5 is formed with channels 6, 6 communicating with one feed port 7 and the cylinder bores 3, 3. The end cap 5 forms a flattened shape long in the tube direction of arrangement (long axis direction) and short in the thickness direction perpendicular to the direction of arrangement (short axis direction). Note that the number of inside cylinder tubes 2*b* may also be three or more.

Each of the cylinder bores 3, 3 houses a piston 10 able to move in the axial direction. Each of the cylinder bores 3, 3 is divided by its piston 10 into left and right cylinder chambers 3*a*, 3*b*. In each piston 10, 11 indicates an inside magnet array. The inside magnet array 11 is comprised of four donut-shaped inside magnets 12 with circular outside circumferences, yokes 13 sandwiched between the magnets 12, a piston shaft 14 inserted through the same, and piston ends 15 fastening the two ends of the magnet array 11 in the axial direction. The magnetic poles of the inside magnets 12, as shown in FIG. 1, are arranged like SN, NS, SN, NS so that the same poles face each other in the axial direction and are arranged so that the same poles face each other between inside magnets 12 of the pistons 10, 10 in the adjoining inside tubes 3*a*.

Reference numeral 20 indicates a slide made of an aluminum alloy arranged at the outside circumference of the outside tube 2*a* and guided so as to move in the axial direction. At the inner circumferential surface of the slide 20 is arranged an outside magnet array 21. The slide 20 forms a flattened shape long in the direction of arrangement (long axis direction) of the inside tube 2*b* and short in the thickness direction perpendicular to the direction of arrangement (short axis direction). The outside magnet array 21 is comprised of four outside magnets 22 forming elliptical ring shapes matching with the outside circumferential shape of the outside tube 2*a*, yokes 23 similarly formed into elliptical ring shapes arranged in the axial direction sandwiched between the outside magnets 22, and wear ring holders 24 fastening the two ends in the axial direction. The magnetic poles of the outside magnet array 21 are arranged so that the magnetic poles face each other in the axial direction and so that the different poles face each other with the magnetic poles of the inside magnet array 11, that is, NS, SN, NS, SN. Due to this arrangement, the two magnet arrays 11, 21 attract each other, whereby the two pistons 10 and single slide 20 are magnetically coupled. Between the inside magnet arrays 11, 11 of the adjoining pair of pistons 10, 10, due to this arrangement of magnetic poles, repulsion force due to the magnetism acts in the long axis direction in the tube cross-section and in the tube axial direction. Due to the magnetic repulsion force in the tube axial direction, the inside magnets 12 of the pistons 10 stop at positions slightly displaced in the tube axial direction with respect to the outside magnet 22.

Figure 4:
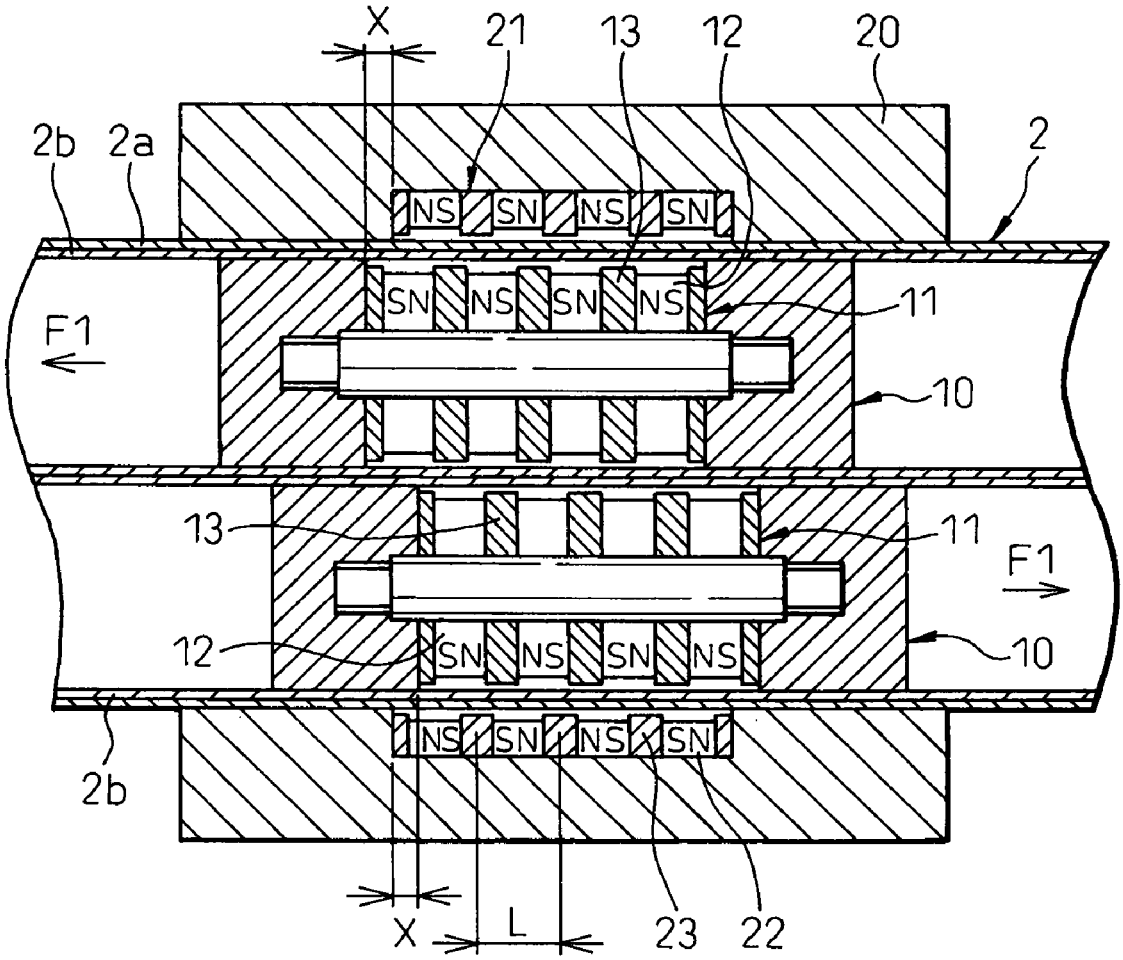
FIG. 4 is a cross-sectional view showing schematically the arrangement of inside and outside magnets in a magnet type rodless cylinder of an embodiment of the present invention.
Figure 5:
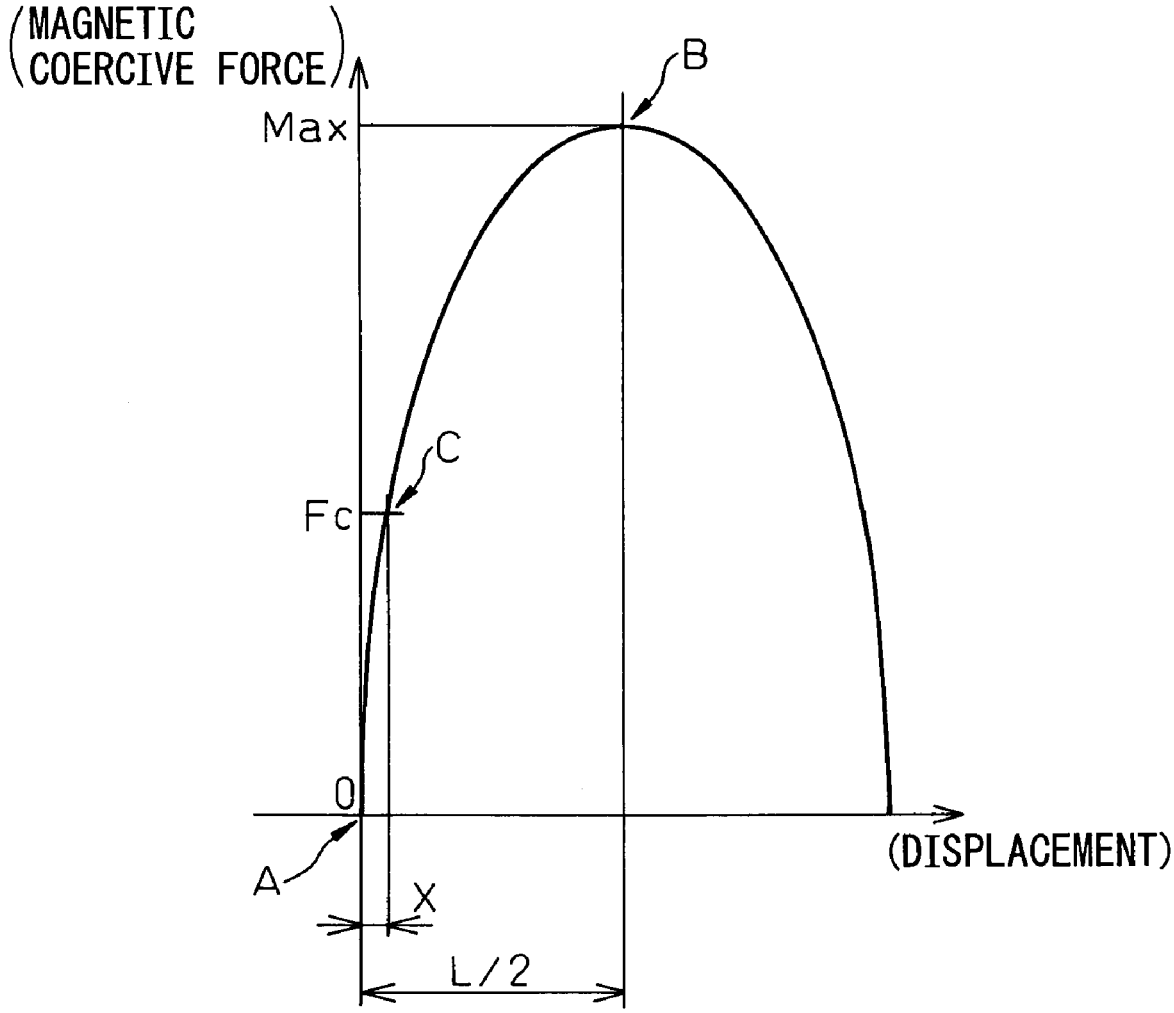
FIG. 5 is a view explaining the relationship between displacement and magnetic coercive force of inside and outside magnets.
Figure 6:
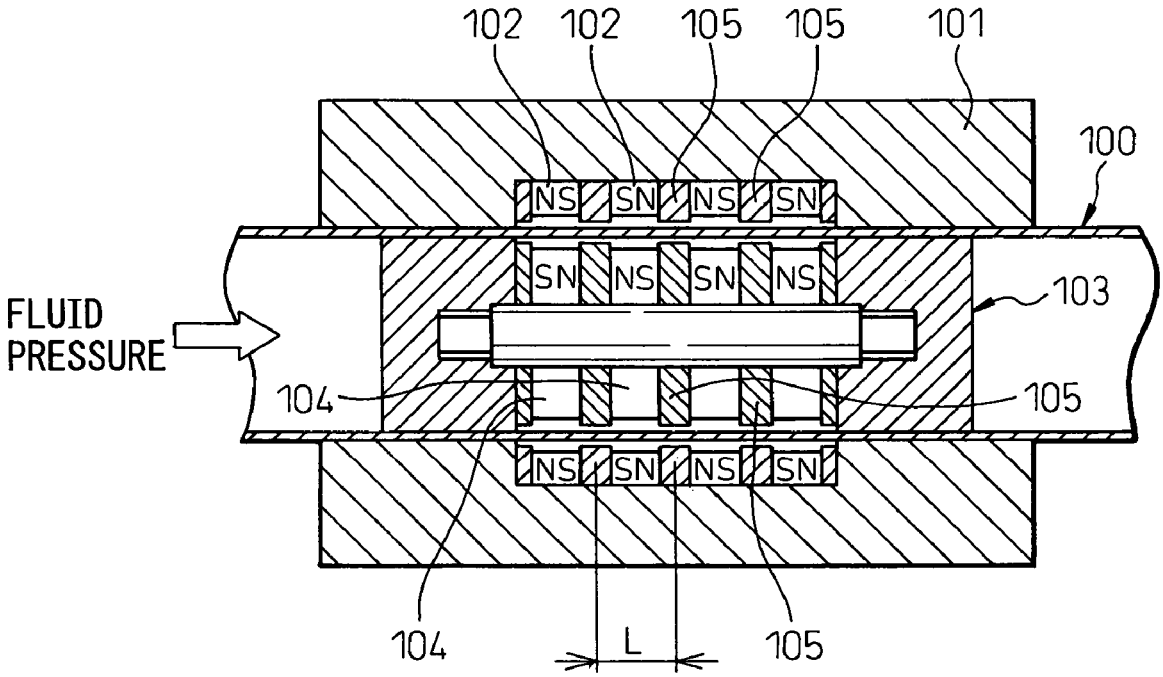
Fig.6 PRIOR ART
FIG. 6 is a cross-sectional view schematically showing the arrangement of inside and outside magnets in a conventional magnet type rodless cylinder.

The state of this displacement is shown exaggeratedly in FIG. 4. In the stationary state, the two adjoining two pistons 10, 10 mutually receive the repulsion force F1 in the axial direction due to the arrangement of magnetic poles of the inside magnets 12 provided there, whereby displacement X occurs in the axial direction with respect to the outside magnets 22 of the slide 20. Due to this displacement X, a magnetic coercive force Fc shown by the point C in FIG. 5 occurs between the inside and outside magnet arrays 12, 22. In this state, if alternately supplying pressurized air or other pressurized fluid from the port 7 provided at the end cap 5 to the inside tubes 2*b*, the two pistons 10 reciprocatingly move inside the inside tubes 2*b*. In accordance with the reciprocating motion of the pistons 10, the slide 20 moves reciprocatingly outside the outside tube 2*a*. In this case, as shown in FIG. 4 and FIG. 5, in the magnet type rodless cylinder of the present invention, even in the stationary state, a magnetic coercive force Fc is generated between the outside magnet 22 and the inside magnets 12, so compared with the conventional case of starting motion from the stationary state where no magnetic coercive force occurs at all (FIG. 6), the occurrence of the stick-slip phenomenon can be suppressed and smooth operation can be obtained.

Further, in this way, the inside pressure for cylinder operation acts exclusively on the inside tubes 2*b* and does not directly act on the outside tube 2*a*, so the outside tube 2*a* with the flattened outside circumference will not suffer from deformation or concentration of stress due to the fluid pressure. Further, the thickness of the tube 2 as a whole becomes the total thickness of the inside cylinder tubes 2*b* and the outside tube 2*a*, but the inside cylinder tubes 2*b* have the thickness t (FIG. 2) similar to the case of the conventional magnet type rodless cylinder and the outside tube 2*a* is not subjected to inside pressure so can be set to a small thickness. For this reason, the total thickness of the inside cylinder tubes and outside tube is not greatly increased compared with using a conventional cylindrical tube with a true circle cross-sectional shape, the magnetic coercive force is not greatly increased, and a very thin, flattened type magnet cylinder can be obtained.

While the invention has been described with reference to specific embodiments chosen for purpose of illustration, it should be apparent that numerous modifications could be made thereto by those skilled in the art without departing from the basic concept and scope of the invention.

The invention claimed is:

1. A magnet type rodless cylinder comprising:

a cylinder tube formed with a noncircular cross-sectional shape, pistons arranged in cylinder bores formed inside said cylinder tube so as to be able to move in a tube axial direction, and a single slide arranged at an outside circumference of said cylinder tube and guided so as to be able to move in the tube axial direction all coupled magnetically, wherein said cylinder tube is comprised of an outside tube with a noncircular cross-sectional shape and a plurality of inside cylinder tubes inserted inside said outside tube, pistons are arranged in cylinder bores formed inside said inside tubes, and said plurality of pistons and said single slide are magnetically coupled.

2. A magnet type rodless cylinder as set forth in claim 1, wherein the cross-sectional shape of said outside tube is a flattened noncircular shape having a long axis and a short axis, said outside tube has two inside cylinder tubes inserted into it, and the cross-sectional shape of the cylinder tube as a whole including said outside tube and the inside tubes is formed as a symmetric shape about a center axis of the length in said long axis direction.

3. A magnet type rodless cylinder as set forth in claim 2, wherein the cross-sectional shape of said outside tube is an elliptical shape and said inside cylinder tubes are arranged in parallel in the long axis direction of the cross-section of the outside tube.

4. A magnet type rodless cylinder as set forth in claim 3, wherein the cross-section of each piston is a true circle, each piston is provided with inside magnets of circular cross-sections corresponding to the piston cross-sectional shape, said slide is provided inside it with outside magnets magnetically coupled with said inside magnets, and the cross-sectional shape of each outside magnet is an elliptical ring shape corresponding to the outside shape of said outside tube.

5. A magnet type rodless cylinder as set forth in claim 4, wherein the inside cylinder tubes are closely arranged so that the pistons arranged in the cylinder bores mutually receive magnetic repulsion force from the inside magnets of the pistons acting in the axial direction and, in the stationary state, the pistons mutually displace in the axial direction.

6. A magnet type rodless cylinder as set forth in claim 3, wherein the inside cylinder tubes are closely arranged so that the pistons arranged in the cylinder bores mutually receive magnetic repulsion force from the inside magnets of the pistons acting in the axial direction and, in the stationary state, the pistons mutually displace in the axial direction.

7. A magnet type rodless cylinder as set forth in claim 2, wherein the inside cylinder tubes are closely arranged so that the pistons arranged in the cylinder bores mutually receive magnetic repulsion force from the inside magnets of the pistons acting in the axial direction and, in the stationary state, the pistons mutually displace in the axial direction.

8. A magnet type rodless cylinder as set forth in claim 1, wherein the inside cylinder tubes are closely arranged so that the pistons arranged in the cylinder bores mutually receive magnetic repulsion force from the inside magnets of the pistons acting in the axial direction and, in the stationary state, the pistons mutually displace in the axial direction.

* * * * *